United States Patent [19]

Toya

[11] Patent Number: 4,580,410

[45] Date of Patent: Apr. 8, 1986

[54] ICE PRODUCT MAKING MACHINE

[75] Inventor: Chiyoshi Toya, Nagoya, Japan

[73] Assignee: Hoshizaki Electric Co., Ltd., Aichi, Japan

[21] Appl. No.: 660,485

[22] Filed: Oct. 11, 1984

[30] Foreign Application Priority Data

Oct. 12, 1983 [JP] Japan ..... 58-189290

[51] Int. Cl.[4] ..... F25C 1/12; F25C 5/10

[52] U.S. Cl. ..... 62/347; 62/352

[58] Field of Search ..... 62/347, 348, 352

[56] References Cited

U.S. PATENT DOCUMENTS

| | | | |
|---|---|---|---|
| 2,746,262 | 5/1956 | Gallo | 62/7 |
| 2,983,109 | 5/1961 | Leeson | 62/73 |
| 3,130,556 | 4/1964 | Goldsborough | 62/352 X |
| 3,246,481 | 4/1966 | Douglas et al. | 62/347 X |
| 4,412,429 | 11/1983 | Kohl | 62/347 |
| 4,442,681 | 4/1984 | Fischer | 62/347 |

*Primary Examiner*—William E. Tapolcai

*Attorney, Agent, or Firm*—Wenderoth, Lind & Ponack

[57] ABSTRACT

An apparatus for making ice product has a vertically arranged refrigerating plate having a freezing surface and a refrigerant pipe on the side of the plate opposite to said freezing surface, and a flushing water spray pipe arranged on the upper portion of the aforementioned side of the refrigerating plate, with the ice-making water flowing down along the freezing surface for formation of ice products. The freezing plate is a strip of sheet metal of lower heat conductivity and comprised of alternate elongated recesses and projections extending in the flowing down direction of the ice making water, with the recesses essentially forming the freezing surface. The freezing surface has a plurality of horizontal formations on the forward sides of the recesses and vertically intermediate the adjoining straight portions of the refrigerant pipe, with the formations extending normal to the flowing down direction of the ice-making water. The ice products of approximately semi-cylindrical configurations are formed on the freezing surface intermediate the horizontal formations.

8 Claims, 7 Drawing Figures

ICE PRODUCT MAKING MACHINE

BACKGROUND OF THE INVENTION

This invention relates to a machine or apparatus for ice making and, more particularly, to a freezing mold of such machine or apparatus wherein ice products are formed from a supply of ice-making water.

There are known various kinds of ice product making machines, with the most popular type being one in which the freezing mold has a multiplicity of ice-making cells formed by a grid of a number of horizontal plates and a number of vertical plates. The ice products obtained by this type of freezing mold are naturally hexahedral in configuration and present sharp edges between the adjoining faces. Although the configuration of the ice product is thought to be desirable in appearance, a larger force is required when the cube ice is to be discharged out of the storage tank with a shovel or a dispenser with the aid of an auger, which means that an electric motor of a larger power output is required for discharging ice products with consequent increase in power consumption. Moreover, these ice products are less mobile due to their configurations and hence are not discharged in constant amounts. In addition, the ice products are stored in the tank in a heap with a larger top angle of approximately 15° relative to the horizontal so that it is not possible to make the best use of the capacity of the storage tank.

Also, in the conventional apparatus for making ice products, the freezing mold is fabricated of copper with higher thermal conductivity so that ice formation is promoted and the ice products formed in the adjoining cells are united together at the open ends of the cells to give an elongated serrated chunk of ice. For obtaining the desired ice products, it is necessary to drop the chunk of ice from a high place to give it an impact and destruct it, in this manner, into separate ice products, with the result that the size of the ice product making machine is necessarily increased. When the descent stroke is reduced for avoiding the bulky size of the apparatus, the resulting ice products present complex configurations different from the design configuration, with the result that the operation of the ice storage sensor provided in the ice storage tank becomes more unreliable. Above all, the ice products may be less mobile and are unable to be discharged in constant amounts by a dispenser.

In this manner, the ice cube making apparatus has a number of deficiencies generally ascribable to the cubic configuration of the ice products.

In addition, although various kinds of the apparatus for making the ice products with other than the cubic configuration are known in the art, there are not so far presented apparatus that are simple in design and inexpensive in manufacture, because the ice-making cells of the freezing mold should be adapted to the configuration of the ice products and hence difficulties are encountered in the preparation of the freezing mold.

SUMMARY OF THE INVENTION

It is therefore an object of the present invention to provide an apparatus for making ice products by means of which ice products that are excellent in appearance and more mobile than the cube ice, that is, approximately semi-cylindrical ice products, can be produced with the aid of a freezing mold which is both simple in design and inexpensive in manufacture.

With the foregoing in mind, the present invention provides an apparatus for making ice products comprising a freezing mold having a freezing surface on which ice products are formed, a meandering refrigerant pipe arranged towards the reverse side of said freezing surface and a flushing water spray pipe mounted to an upper part of said reverse side, the ice-making water flowing down along said freezing surface for forming ice products, characterized in that said freezing mold comprises a strip of sheet metal of a smaller thickness and a lower heat conductivity, said strip is bent vertically at constant pitches so as to present a plurality of elongated recesses extending in the flowing down direction of the ice-making water and alternating with a plurality of elongated projections similarly extending in the flowing down direction of the ice-making water and projecting from said freezing surface, said projections opening on the reverse sides so as to form corresponding grooves, said refrigerant pipe meandering so as to present a plurality of straight portions connected together at the both ends by U-shaped bends, said straight portions being spaced apart a predetermined distance from one the other in the flowing down direction of the ice making water and repeatedly intersecting said recess and projections, said refrigerant pipe contacting with the reverse side portions of the freezing mold corresponding to said recesses in heat exchange relation therewith, said freezing surface also presenting a plurality of projecting formations extending at right angles with the flowing down direction of the ice-making water.

When the refrigerant is supplied into the refrigerant pipe of the apparatus and the ice-making water is caused to flow down along the freezing surface, the ice product of a configuration such that thickness of the product in a direction normal to the freezing surface is reduced upwardly and downwardly from a maximum value at the contact point between the refrigerant pipe and the reverse side of the recess, that is, the approximately semi-cylindrical ice product, is formed, because the freezing mold is formed of a metal sheet strip of lower thickness and lower heat conductivity and the refrigerant pipe is not contacted with the reverse side of the associated projections.

BRIEF DESCRIPTION OF THE DRAWINGS

In the drawings illustrating the apparatus of the present invention.

DESCRIPTION OF THE PREFERRED EMBODIMENT

Figure 1:
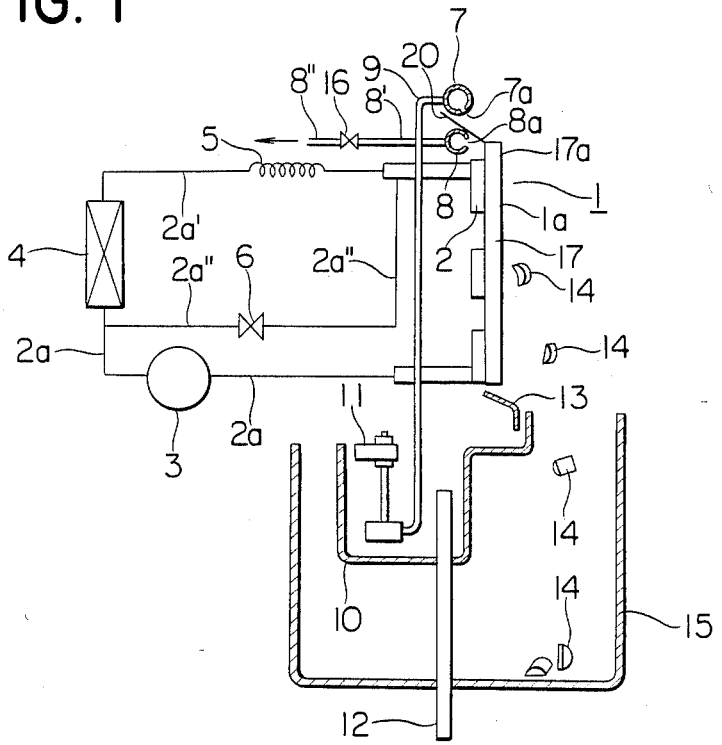
FIG. 1 is a schematic overall view of the apparatus.

The ice product making machine according to a preferred embodiment of the present invention will be hereafter described by referring to the accompanying drawings.

In these drawings, the numeral 1 denotes an ice-making or freezing mold which is mounted approximately vertically and generally formed of a metallic plate having lower thermal conductivity than copper, such as a stainless steel plate, which is 0.3 mm in thickness. A continuous meandering refrigerant pipe 2 having several horizontal portions connected together by U-shaped bends is mounted approximatey horizontally on the back surface of the freezing mold 1.

The lower end of the refrigerant pipe 2 is connected via a pipe 2*a* to a compressor 3, which in turn is connected via a condenser 4, a pipe 2*a'* and a capillary tube 5 to the upper end of the refrigerant pipe 2.

The outlet side of the compressor 3 also is connected via a first magnetic valve 6 and a bypass tube 2*a''* to the upper end of the cooling pipe 2, and a hot gas is supplied into the refrigerant pipe 2 upon opening the first magnetic valve 6.

On top of the freezing mold 1, elongated ice-making water spray tube 7 having a large number of water outlet apertures 7*a* and an elongated flushing water spray tube 8 having a large number of water outlet apertures 8*a* are provided one upon the other, with the ice-making water spray tube 7 being connected, via an ice-making water pipe 9, to a circulating pump 11 provided in an ice-making water tank 10 which is mounted below the freezing mold 1.

The ice-making water tank 10 is provided with an overflow tube 12 and an angle deflector 13, which is mounted to the upper end of the tank 10 and so designed that the unfrozen water falling from the mold 1 is guided into the water tank 10 and the ice products are guided into an ice product storage tank 15 provided around the ice-making water tank 10.

The flush water spray tube 8 mounted below the ice-making water spray tube 7 is connected, via a pipe 8' and a second magnetic valve 16, to, for example a water main 8'', so that not only flush water for defrosting operation can be supplied to the machine, but also the ice-making water can be supplied thereto whenever the ice-making water in the tank 10 is about to be depleted.

Figure 2:
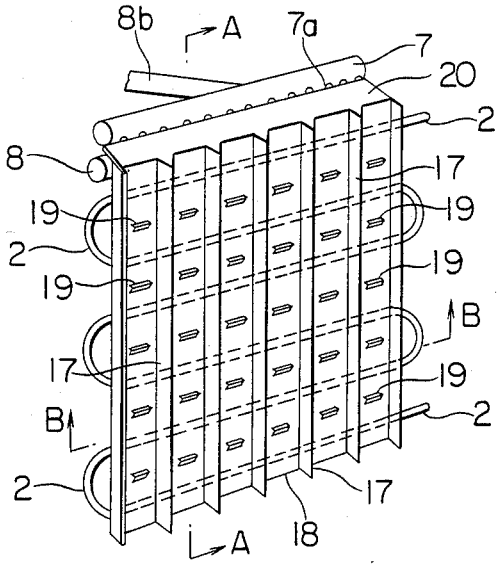
FIG. 2 is a perspective view showing the freezing mold.
Figure 3:
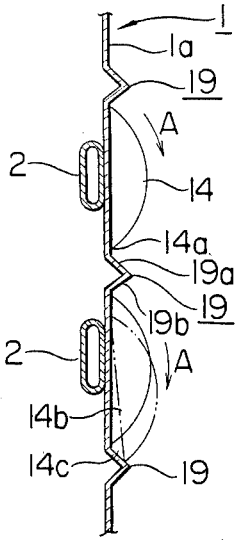
FIG. 3 is a sectional view taken along line A—A in FIG. 2.
Figure 4:
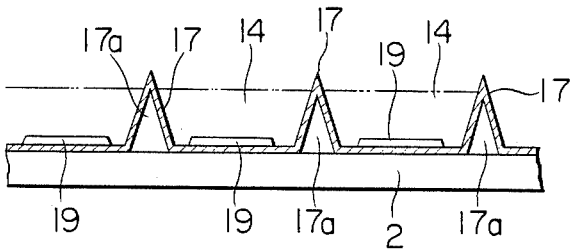
FIG. 4 is a sectional view taken along line B—B in FIG. 2.

Referring to FIGS. 2 to 4, the mold 1 has a freezing surface 1*a* formed with a number of vertically extending parallel ribs 17 or projections that are spaced apart horizontally from one another when viewed in FIG. 4. These ribs 17 are vee shaped in cross-section so that a number of grooves 17*a* are formed on the reverse sides of the ribs 17.

A vertically extending ice-making recess 18 is defined between adjacent ribs 17. A number of formations 19 are formed in each recess 18 as one with the mold 1 and are vertically spaced apart from one another. These formations 19 are spaced apart slightly from and extend at right angles to the associated ribs. As shown in FIGS. 3 and 4, each formation 19 is of a sufficiently lesser height than the rib 17 and has a surface 19*a* which is at the upstream side of the formation 19 with respect to the flowdown direction "A" of the ice-making water and which is inclined down at an angle from the ice-making surface 1*a*, so that, as the lower edge 14*a* of an ice product 14 disposed right above the inclined surface 19*a* is shifted down during harvesting, it rides on the surface 19*a* so as to produce an air gap 14*c* between a flat bottom surface 14*b* of the ice product 14 and the ice product making surface 1*a* so as to facilitate the removal of the ice product 14 from the surface 1*a*. While the downstream side surface 19*b* is also shown to be inclined with respect to the ice product making surface 1*a*, it can be merged with the surface 1*a* at right angles therewith.

Figure 5:
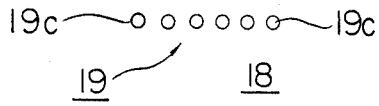
FIG. 5 is a front view showing a modified horizontal formation.

While the formations 19 are formed as horizontal ribs in the present embodiment, these can be replaced by a row of a number of beads or bosses 19*c*, as shown in FIG. 5, for producing similar results.

The formations 19 are provided on a straight line between adjacent straight portions of the refrigerant pipe 2. Since the freezing mold 1 is formed of a material with a lower heat conductivity and the formations 19 are positioned intermediate with respect to the straight portions of the pipe 2, in such a manner that the formations are chilled to a lesser extent and the process of ice formation is possibly terminated short of these formations.

The upper extreme portion of the mold 1 is formed as an inclined partition plate 20 which is positioned between the ice-making water spray tube 7 and the flush water spray tube 8 so that the ice-making water from the tube 7 flows down on the surface 1*a* of the freezing mold 1.

The water outlet apertures 8*a* of the spray tube 8 are in a facing relation to the grooves 17*a* on the reverse sides of the ribs 17 so that flush water issuing from the apertures 8*a* flow down directly into the grooves 17*a* of the projections 17.

The operation of the above described ice product making machine is now explained. Supposing that the ice making cycle is continued in the state shown in FIG. 1, the ice-making water is supplied from the spray tube 7 to the surface 1*a* of the mold 1 so that the ice-making water is chilled by the refrigerant flowing through the pipe 2 as the water flows down the surface 1*a*.

The water starts to be frozen gradually within each vertically extending ice-making recess 18 on the surface 1*a*. Since the stainless steel material from which the mold 1 is made has a lower thermal conductivity than copper, ice formation in the vertical direction is retarded, and an approximately semi-cylindrical ice product 14 is formed, with the centerline or axis of the half cylinder lying on the associated straight section of the pipe 2 (FIG. 3). When the ice product 14 has grown to a sufficient size, completion of ice making is sensed by known means such as thermostat or timer. This causes the operation of the circulating pump 11 to be stopped and the first magnetic valve 6 to be opened so that the hot gas is supplied via bypass pipe 2*a''* into the refrigerant pipe 2 and the ice product 14 starts to be melted on a surface 14*b* thereof which contacts the freezing surface 1*a*. The mold 1 has lower thermal conductivity and therefore those portions of the ice product 14 that are remote from the pipe 2 are less likely to be melted than the center portion of the ice product. Thus the second magnetic valve 16 is also opened for supplying flushing water into the reverse side grooves 17*a* of the ribs 17 from the spray tube 8. In this manner, the side edges of the ice product 14 are also melted and the ice product 14 starts to slide down in the recess 18 under the influence of gravity while it is in tight contact with the freezing surface 1*a* under the effect of surface tension of the water. The lower edge 14*a* of the ice product 14 reaches and rides on the upstream inclined surface 19*a* of the horizontal formation 19 so that an air gap 14*c* is formed between the flat surface 14*b* of the ice product 14 and the freezing surface 1*a*. Thus the ice product 14 can be easily detached from the surface of the vertical ice-making recess 18 and discharged into the tank 15. It should be noted that the hot gas is usually applied to the extreme upper straight portion of the pipe 2 first of all and the heating effect of the gas is lowered gradually as it flows down past the subjacent straight portions. Therefore, the ice product 14 located at a higher position on the freezing surface 1*a* tends to be detached from the surface 1*a* more readily than the product located at a lower position. Thus, assuming that there were no horizontal formation 19, the upper ice product melted earlier would descend onto the directly subjacent ice product which would then hold and cause the firstly melted ice product to be melted further. This would causes the ice products to be nonuniform in size and shape and the ice-making capacity to be correspondingly lowered.

Once the totality of the ice products 14 are detached from the mold, such state is sensed by, for example, a thermostat, not shown, and the ice product making cycle is again initiated.

From the foregoing it is seen that the ice product making machine of the present invention provides an arrangement in which the freezing mold is formed with vertical ice-making recesses and horizontal formations from the same stainless steel material for forming separate semi-cylindrical ice products instead of ice cubes, these ice products are stored in the tank in a heap with an angle of inclination of about 15° which is smaller than about 45° for the ice cube so that improvement may be achieved in the ice storage efficiency.

In addition, because of the approximately semi-cylindrical shape of the ice products, no large force is required for scooping them with a shovel. In addition, when a dispenser having a transport screw is used for dispensing the ice products, the transport screw can be driven by a small-sized motor with a lesser torque output for a given volume of the ice products because of the generally smooth configurations of the ice products. In this manner, a predetermined constant amount of the ice products can be dispensed to the user so that improvement may be achieved in reliability of the automatic vender of the ice products.

Figure 6:
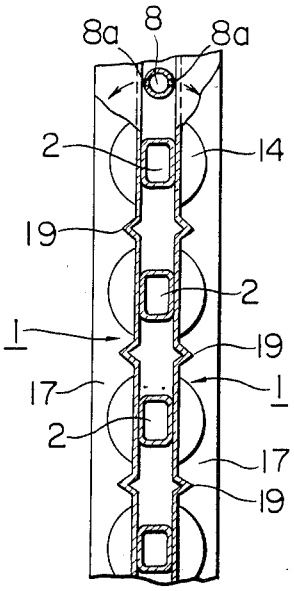
FIG. 6 is a side elevation showing an alternative embodiment of the freezing mold.
Figure 7:
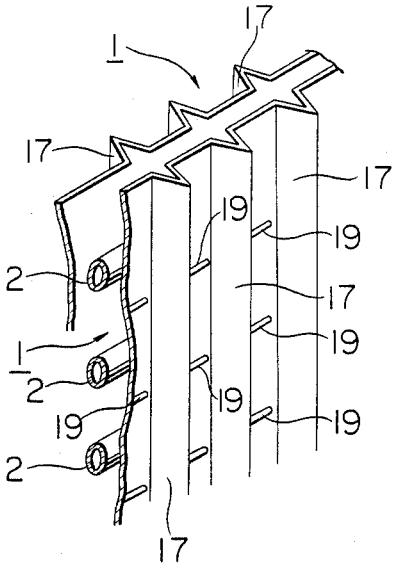
FIG. 7 is a perspective view showing essential parts shown in FIG. 6.

In the above described embodiment, only one surface of the freezing mold 1 is designed as an ice-making or freezing surface 1*a*. According to a modification shown in FIGS. 6 and 7, a pair of such freezing molds 1 can be provided back-to-back so that the flush water spray tube 8 has its water outlet apertures 8*a* sandwiched between the freezing molds 1 so as to prevent the droplets of the flushing water from being scattered and to make the best use of the flushing water.

What we claim is:

1. In an apparatus for making ice products comprising a freezing mold having a freezing surface on which ice products are formed, a meandering refrigerant pipe arranged towards the reverse side of said freezing surface, a flushing water spray pipe mounted to an upper part of said reverse side and an ice-making water spray tube mounted above said freezing surface for supplying ice-making water to said freezing surface wherein the ice-making water flows downwardly along said freezing surface for forming ice products, said freezing mold comprising a strip of sheet metal of small thickness and low heat conductivity, said strip being bent vertically at a constant pitch so as to present a plurality of elongated recesses extending in the flowing down direction of the ice-making water and alternating with a plurality of elongated projections similarly extending in the flowing down direction of the ice-making water and projecting from said freezing surface, said projections opening on the reverse sides so as to form corresponding grooves, said refrigerant pipe presenting a plurality of straight portions connected together at both ends by U-shaped bends, said straight portions being spaced apart a predetermined distance one from the other in the flowing down direction of the ice-making water and repeatedly intersecting said recesses and projections, said refrigerant pipe being in contact with the reverse side portions of the freezing mold corresponding to said recesses in heat exchange relation therewith so that vertically spaced apart approximately semi-cylindrical ice products centered over said refrigerant pipe are formed in each of said recesses during an ice-making cycle of said apparatus, the improvement wherein said apparatus further comprises means for introducing air between a bottom portion of the ice products and said freezing surface during a harvesting cycle after the ice-making cycle so as to separate the ice products from said freezing surface, said air introducing means including a plurality of projecting formations on said freezing surface in said recesses, extending at right angles to the flowing down direction of the ice-making water, said projecting formations projecting from said freezing surface to a lesser extent than said elongated projections and being positioned on said freezing surface such that the straight portions of said refrigerant pipe contact the reverse side portions of said freezing surface at points lying between said projecting formations, said apparatus further comprising means for terminating said ice-making cycle and beginning said harvesting cycle with the lower edge of the ice products substantially out of contact with said projecting formations immediately therebelow, such that during said harvesting cycle, the ice products slide downward on said freezing surface onto the projecting formations directly therebelow so as to introduce air between the bottom portion of the ice products and direct the ice products outward of said freezing surface.

2. An apparatus as claimed in claim 1 characterized in that each of said projecting formations extending at right angles to downward water flow has a height from the freezing surface which becomes greater as the projecting formation extends from the freezing surface and in the direction of downward water flow.

3. An apparatus as claimed in claim 1 wherein said flushing water spray pipe has water outlet apertures at positions for spraying flushing water onto the reverse side grooves of said elongated projections.

4. An apparatus as claimed in claim 3 wherein said elongated projections are vee shaped in cross-section.

5. An apparatus as claimed in claim 1 wherein said strip of sheet metal is fabricated from stainless steel.

6. An apparatus as in claim 1, wherein each of said projecting formations is horizontally spaced from the elongated projections immediately adjacent thereto on opposite sides thereof which define therebetween the recess in which the projecting formation is located, to thereby define vertically elongated spaces for guiding ice-making water in said downward water flow direction on said freezing surface between said projecting formations and the elongated projections immediately adjacent thereto.

7. In an apparatus for making ice products comprising a freezing mold having a freezing surface on which ice products are formed, a meandering refrigerant pipe arranged towards the reverse side of said freezing surface, a flushing water spray pipe mounted to an upper part of said reverse side and an ice-making water spray tube mounted above said freezing surface for supplying ice-making water to said freezing surface wherein the ice-making water flows downwardly along said freezing surface for forming ice products, said freezing mold comprising a strip of sheet metal of small thickness and low heat conductivity, said strip being bent vertically at a constant pitch so as to present a plurality of elongated recesses extending in the flowing down direction of the ice-making water and alternating with a plurality of elongated projections similarly extending in the flowing down direction of the ice-making water and projecting from said freezing surface, said projections opening on the reverse sides so as to form corresponding grooves, said refrigerant pipe presenting a plurality of straight portions connected together at both ends by U-shaped bends, said straight portions being spaced apart a predetermined distance one from the other in the flowing down direction of the ice-making water and repeatedly intersecting said recesses and projections, said refrigerant pipe being in contact with the reverse side portions of the freezing mold corresponding to said recesses in heat exchange relation therewith, the improvement wherein said freezing surface also has in said recesses a plurality of projecting formations extending at right angles to the flowing down direction of the ice-making water said projecting formations projecting from the freezing surface to a lesser extent than said elongated projections and being positioned on said freezing surface such that the straight portions of said refrigerant pipe contact the reverse side portions of the freezing surface at points lying between said projecting formations so that during an ice-making cycle an ice product of semi-cylindrical shape is formed on the freezing surface in which the lower edge portion of each individual ice product does not substantially contact the projecting formation which is at right angles to downward water flow direction and which is immediately below the ice product, said flushing water spray pipe having water outlet apertures at positions for spraying flushing water onto the reverse side grooves of said elongated projections.

8. In an apparatus for making ice products comprising a freezing mold having a freezing surface on which ice products are formed, a meandering refrigerant pipe arranged towards the reverse side of said freezing surface, a flushing water spray pipe mounted to an upper part of said reverse side and an ice-making water spray tube mounted above said freezing surface for supplying ice-making water to said freezing surface wherein the ice-making water flows downwardly along said freezing surface for forming ice products, said freezing mold comprising a strip of sheet metal of small thickness and low heat conductivity, said strip being bent vertically at a constant pitch so as to present a plurality of elongated recesses extending in the flowing down direction of the ice-making water and alternating with a plurality of elongated projections similarly extending in the flowing down direction of the ice-making water and projecting from said freezing surface, said projections opening on the reverse sides so as to form corresponding grooves, said refrigerant pipe presenting a plurality of straight portions connected together at both ends by U-shaped bends, said straight portions being spaced apart a predetermined distance one from the other in the flowing down direction of the ice-making water and repeatedly intersecting said recesses and projections, said refrigerant pipe being in contact with the reverse side portions of the freezing mold corresponding to said recesses in heat exchange relation therewith, the improvement wherein said freezing surface also has in said recesses a plurality of projecting formations extending at right angles to the flowing down direction of the ice-making water said projecting formations projecting from the freezing surface to a lesser extent than said elongated projections and being positioned on said freezing surface such that the straight portions of said refrigerant pipe contact the reverse side portions of the freezing surface at points lying between said projecting formations so that during an ice-making cycle an ice product of semi-cylindrical shape is formed on the freezing surface in which the lower edge portion of each individual ice product does not substantially contact the projecting formation which is at right angles to downward water flow direction and which is immediately below the ice product, each of said projecting formations being horizontally spaced from the elongated projections immediately adjacent thereto on opposite sides thereof which define therebetween the recess in which the projecting formation is located, to thereby define vertically elongated spaces for guiding ice-making water in said downward water flow direction on said freezing surface between said projecting formations and the elongated projections immediately adjacent thereto.

* * * * *